US007351088B1

(12) United States Patent
Qu

(10) Patent No.: US 7,351,088 B1
(45) Date of Patent: Apr. 1, 2008

(54) ELECTRICAL CONNECTOR WITH SELF-LOCKING BY SNAP-FASTENING

(76) Inventor: Jinliang Qu, Room 302, Gudai Road 1266-48, Shanghai 201102 (CN)

( * ) Notice: Subject to any disclaimer, the term of this patent is extended or adjusted under 35 U.S.C. 154(b) by 0 days.

(21) Appl. No.: 11/762,804

(22) Filed: Jun. 14, 2007

(30) Foreign Application Priority Data

Sep. 29, 2006 (CN) ..... 2006 2 0046522 U

(51) Int. Cl.
*H01R 13/627* (2006.01)

(52) U.S. Cl. ..... 439/352

(58) Field of Classification Search ..... 439/352, 439/578, 350

See application file for complete search history.

(56) References Cited

U.S. PATENT DOCUMENTS 6,709,289 B2 3/2004 Huber et al.
7,165,982 B2 * 1/2007 Hafele et al. ..... 439/127
7,189,097 B2 * 3/2007 Benham ..... 439/352
7,238,047 B2 * 7/2007 Saettele et al. ..... 438/578
2003/0027435 A1 2/2003 Schneider et al.

* cited by examiner

*Primary Examiner*—Phuong Dinh
(74) *Attorney, Agent, or Firm*—Hammer & Hanf, P.C.

(57) ABSTRACT

An electrical connector, a ring-like locking sheet with inner and outer teeth of which is fixed at the end of its plug connector; and a circumferential bulge, with trapezoid cross section which has an upslope, a flat top and a down-slope, is provided on the surface of the outer conductor of the socket connector. Therefore, in the process of connection, the inner teeth reach the max flexural deformation when go up along the slope to the flat top. When reach the down-slope, the deformed inner teeth gradually restore the original state in tangential direction of the down-slope, and finally stop at the down-slope or at the juncture of the down-slope and the flat top. The electrical connector according to the present invention can have a rigid zero clearance between the interfaces in connection, and at the same time can keep a very strong axial force. The RF coaxial connector according to the present invention has continuous impedance between the contact surfaces, reliable and stable contact, greatly reduced RF emission, as well as the same operating frequency, excellent RF performance and good passive intermodulation as those with threaded connection.

10 Claims, 6 Drawing Sheets

ELECTRICAL CONNECTOR WITH SELF-LOCKING BY SNAP-FASTENING

FIELD OF THE INVENTION

The present invention is related to an electrical connector, in particular, an electrical connector with self-locking by snap-fastening. The RF coaxial connector according to the present invention has continuous impedance on the contact surfaces between its plug and socket, with little reflection caused by the transmission of electromagnetic waves on the contact surfaces and therefore with greatly reduced RF emission.

PRIOR ART

U.S. Pat. No. 6,709,289B2 discloses an electrical connector with self-locking by snap-fastening, making use of the elasticity of an elastic element 42 to eliminate the clearance between the contact surfaces 46, 47 caused by the machining error of the spare parts 35, 38, and at the same time to gain the axial forces between the plug 35 and the socket 38 by the elasticity of said elastic element 42. However, there exists such a problem that the impedance between the plug 35 and the socket 38 is discontinuous in the position of the said elastic element. Therefore, reflection, which will worsen the VSWR, will be caused between the plug and the socket in the transmission of electromagnetic waves (See FIGS. 9 and 10).

Therefore, in prior art, the RF coaxial connector according to U.S. Pat. No. 6,709,289B2 is with a limited operating frequency and is not with as good electrical performance as the RF coaxial connector with the threaded connection, especially in the operating frequency of 6-11 GHz.

The US2003/0027435A1 also has the similar problem.

SUMMARY OF THE INVENTION

The object of the present invention is to provide an electrical connector with self-locking by snap-fastening, the contact surfaces between the plug and the socket of which have continuous impedance so as to avoid reflection on them caused by the transmission of electromagnetic waves.

Another object of the present invention is to provide an electrical connector with self-locking by snap-fastening with very small and stable contacting resistance between its plug and socket.

Another object of the present invention is to provide an electrical connector with self-locking by snap-fastening, which has good passive intermodulation in connection between its plug and socket, a low insertion loss, and a greatly reduced RF emission.

Another object of the present invention is to provide an electrical connector with self-locking by snap-fastening with good seal effect and anti-shock performance.

Another object of the present invention is to provide an electrical connector with self-locking by snap-fastening which is simple in structure and easy in manufacturing, which needs no change or just a little change of the inner size of the present RF coaxial connector with thread connection to be updated to a connector with self-locking by snap-fastening, so as to save a lot of time of design and test.

Therefore, the present invention provides an electrical connector with plug connector and socket connector, characterized in that a ring-like locking sheet with inner and outer teeth is provided at the end of its plug connector, and a circumferential bulge, with a trapezoid cross section which has upslope, flat top and down-slope, is provided on the surface of the outer conductor of the socket connector, thus, during connecting, said inner teeth reach its maximum flexural deformation when rise along the upslope to the flat top, then, when move to the down-slope, the deformed inner teeth gradually restore their original state in the tangential direction of the down-slope, and finally stop at the down-slope or at the juncture of the down-slope and a flat valley. The end faces of the inner teeth thrust the down-slope in the normal direction of the down-slope, making closely contact between the faces with zero clearance and with relatively strong axial forces.

Preferably, the plug connector comprises an outer conductor and a core conductor, and the socket connector also comprises an outer conductor and a core conductor. When the plug connector is connected to the socket connector, the two outer conductors are connected to each other, and so are the two core conductors.

Preferably, the adjacent inner teeth of the ring-like locking sheet with inner and outer teeth have different lengths, which enable the inner teeth stop on different circumferences of the down-slope in locking. The included angle between the longer teeth and the down-slope is $\geqq 90°$ while that between the shorter teeth and the down-slope is $\leqq 900$.

Preferably, the outer teeth of the ring-like locking sheet with inner and outer teeth are located on the same circumference and fixed between the end face of the outer conductor and a clamp ring. Slits are provided both between the outer teeth and between the inner teeth.

Preferably, the plug connector has an inner bore which is matched with the flat top of the socket connector.

Preferably, the clamp ring tightly presses the outer teeth of the locking sheet.

Preferably, the outer conductor of the plug connector has circumferential groove with an O-ring seal in it.

Preferably, an unlocking sleeve is also provided with its unlocking part being in alignment with the unlocking part of the locking sheet.

Preferably, between the plug connector's middle cylindrical surface with a shorter inner diameter and the plug connector's front end cylindrical surface with a longer inner diameter, there is arranged a circumferential groove defined by C-shaped three inner walls with an O-ring seal being in the groove.

Preferably, in connection of said electrical connector, the plug connector's middle cylindrical surface with a shorter inner diameter faces the front end cylindrical surface of the socket connector, while the plug connector's front end cylindrical surface with a longer inner diameter faces the upslope of the circumferential bulge of the socket connector.

In connection, the electrical connector according to the present invention can have a rigid zero clearance between the interfaces, with a very strong axial force, continuous impedance between the contact surfaces, reliable and stable contact, and a greatly reduced RF emission, as well as the same operating frequency, excellent RF performance and good passive intermodulation as those with threaded connection.

According to the electrical connector of the present invention, between the plug connector's middle cylindrical surface with a shorter inner diameter and the plug connector's front end cylindrical surface with a longer inner diameter, there is arranged a circumferential groove defined by C-shaped three inner walls with an O-ring seal being in the groove. Especially, in connection of said electrical connector, the plug connector's middle cylindrical surface with a shorter inner diameter faces the front end cylindrical surface of the socket connector, while the plug connector's front end cylindrical surface with a longer inner diameter faces the upslope of the circumferential bulge of the socket connector. With such a structure, during connecting of said electrical connector, the O-ring seal of the plug connector has no slippage with respect to the upslope of the circumferential bulge of the socket connector, and has no wear abrasion, while the O-ring seal itself deforms elastically, strongly pressing the three inner walls of the groove, the front end cylindrical surface of the socket connector, and the upslope of the circumferential bulge of the socket connector. Therefore, according to the electrical connector of the present invention, the O-ring seal has a very well sealing effect, a very good anti-vibration capacity, and a long service life.

Especially, according to the electrical connector of the present invention, its operating frequency is with electrical performance as good as the RF coaxial connector with the threaded connection, especially in the operating frequency of 6-11 GHz.

DETAILED DESCRIPTION OF THE PRESENT INVENTION

Figure 1:
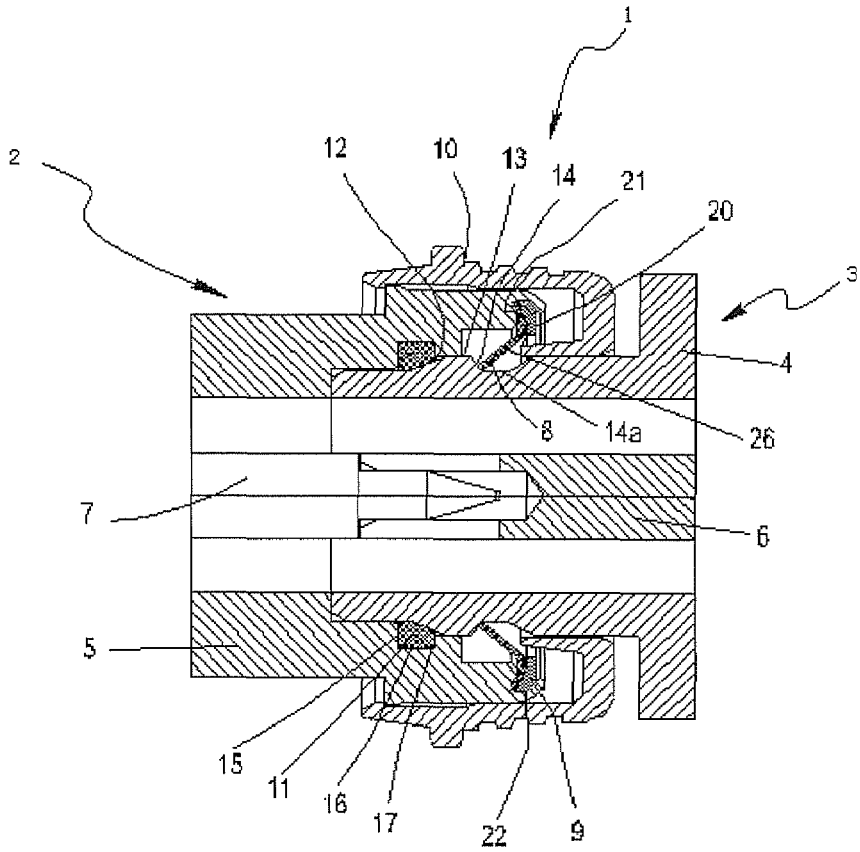
FIG. 1 shows a schematic view of the structure of the electrical connector according to the present invention in the connection of the plug connector and the socket connector.

According to an embodiment of the present invention, as shown in FIG. 1, an electrical connector with self-locking by snap-fastening comprises a plug connector 2 and a socket connector 3.

Figure 2:
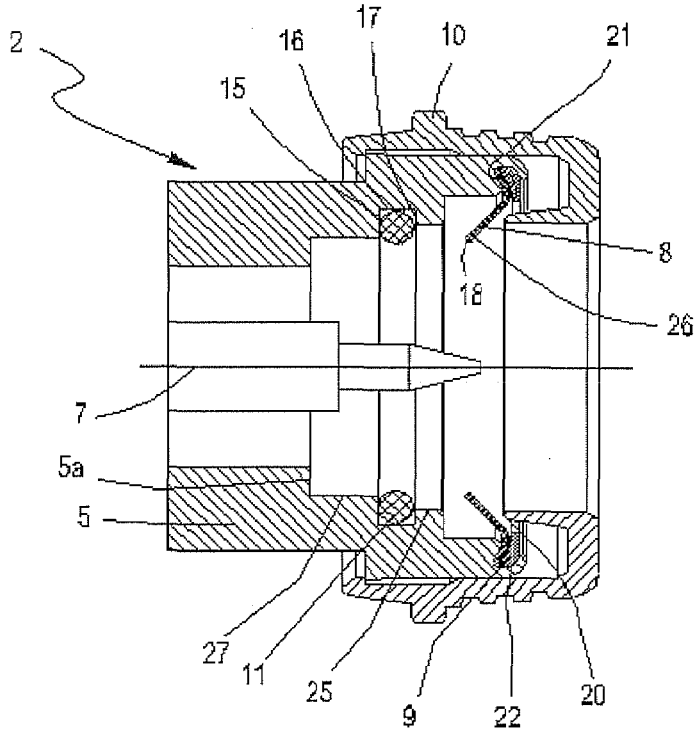
FIG. 2 shows a schematic view of the structure of the plug connector of the electrical connector according to the present invention.

As shown in FIG. 2, the plug connector 2 comprises an outer conductor 5 and a core conductor 7. A ring-like locking sheet with inner and outer teeth 8 made of elastic material and a clamp ring 9 are arranged in portions 21, 22 of the outer conductor 5, and an unlocking sleeve 10 is mounted on the radial exterior of the outer conductor 5. On the inner surface of the outer conductor 5, there is a circumferential groove defined by inner walls 15, 16, 17 with an O-ring seal in it.

Figure 3:
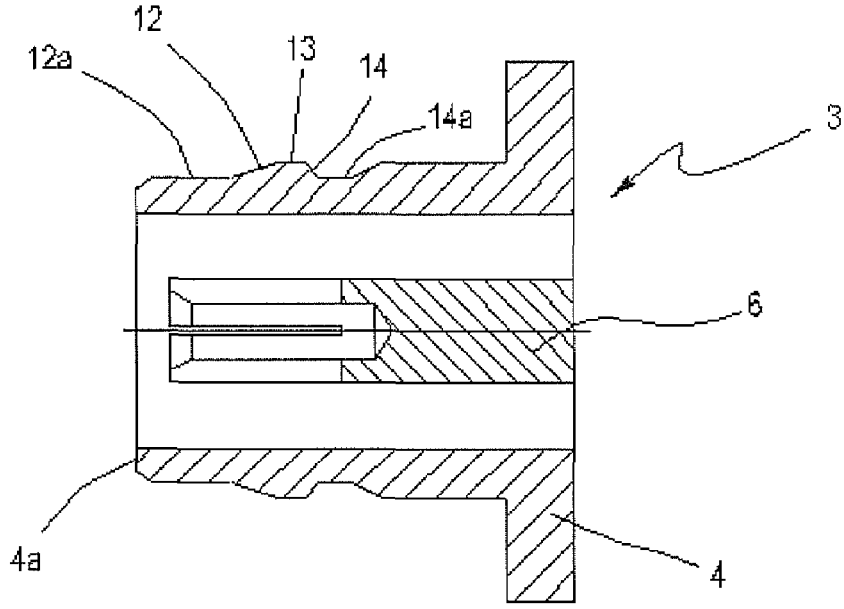
FIG. 3 shows a schematic view of the structure of the socket connector of the electrical connector according to the present invention.

As shown in FIG. 3, the socket connector 3 comprises an outer conductor 4 and a core conductor 6 which is made of elastic material with an end hole facing the conductor 7. Several longitudinal slits are provided on the wall of the end hole to make the core conductor 6 elastic, and therefore easy connecting with core conductor 7. The exterior surface of the outer conductor 4 is provided with a ring with trapezoid cross section, which has an upslope 12, a flat top 13 and a down-slope 14. The upslope 12 can cause the locking sheet 8 flexurally deformed when the inner teeth 24 of the locking sheet 8 are driven to be sliding on the upslope, so as to accumulate energy. The flat top 13 is provided to be in engagement with an inner bore 25 of the plug connector 2 to keep coaxiality between the plug connector 2 and the socket connect 3. The down-slope 14 can help the locking sheet 8 to restore its original state before the flexural deformation when the inner teeth 24 of the locking sheet 8 are sliding on it, so as to lock the connector 2.

In the connection of this connector with self-locking by snap-fastening, the top 18 of each of inner teeth 24 of the locking sheet 8 rapidly release in the tangential direction of the down-slope 14 most of the energy accumulated during the flexural deformation of locking sheet 8 in connection. At the same time, when the inner teeth 24 release the accumulated energy, the top 18 of them generate a strong thrust force in the normal direction of down-slope 14. The resultant force of all these thrust forces at the tops 18 of the inner teeth 24 forms the contact pressure of the contact surface 4*a* to surface 5*a* as shown FIG. 1.

Figure 8A:
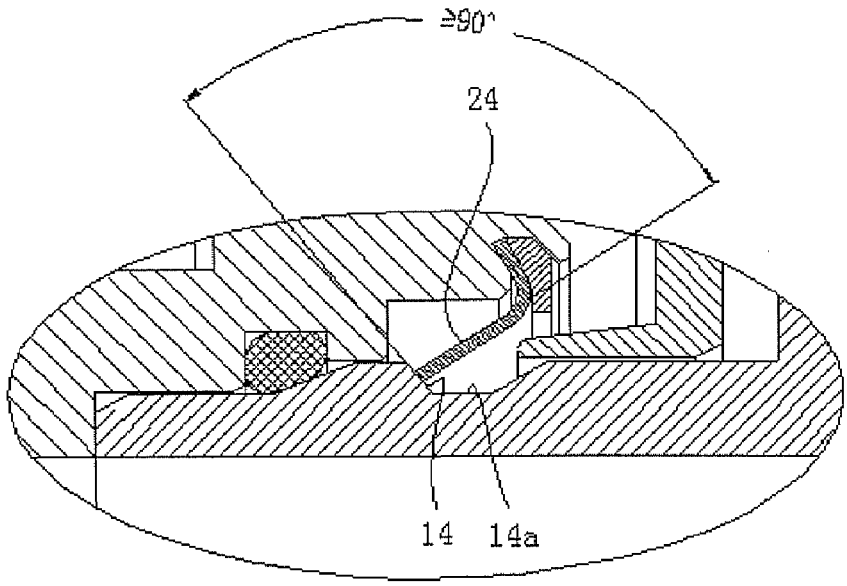
FIGS. 8*a* to 8*c* show the generation principle of the axial force in the electrical connector according to the present invention.
Figure 8B:
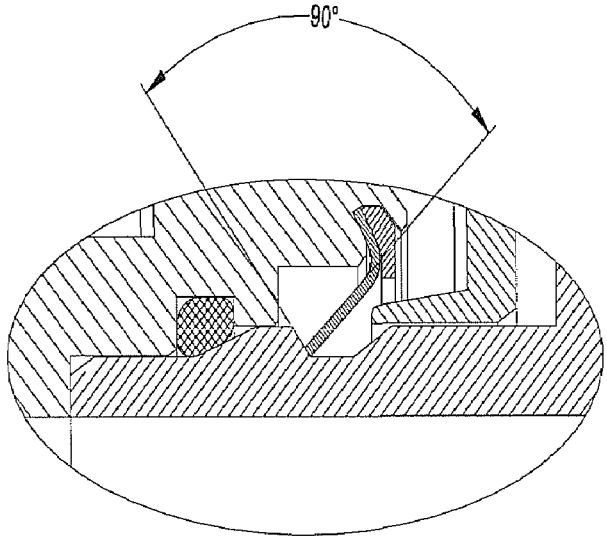
Figure 8C:
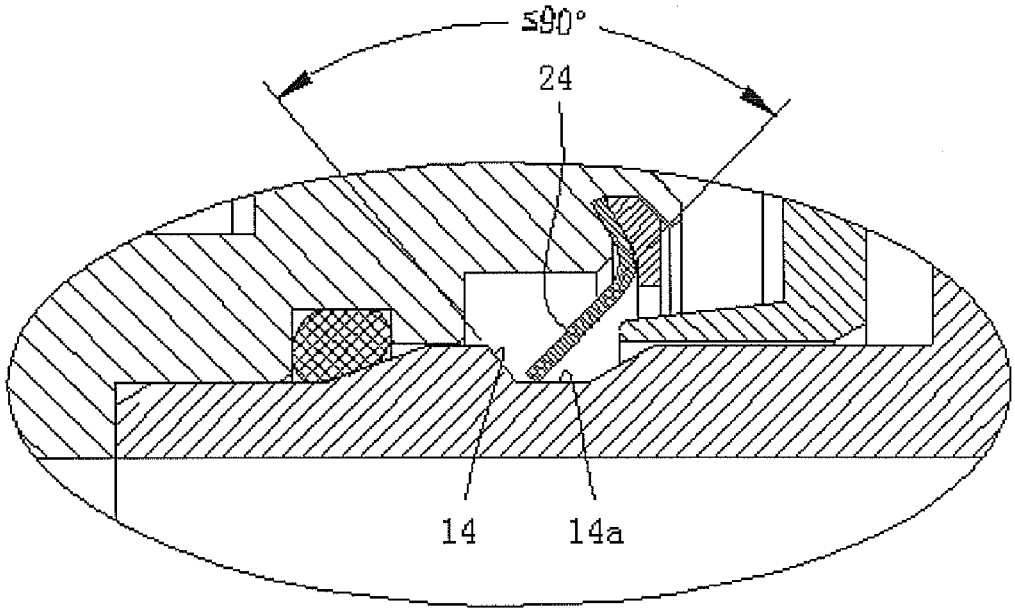
Figure 9:
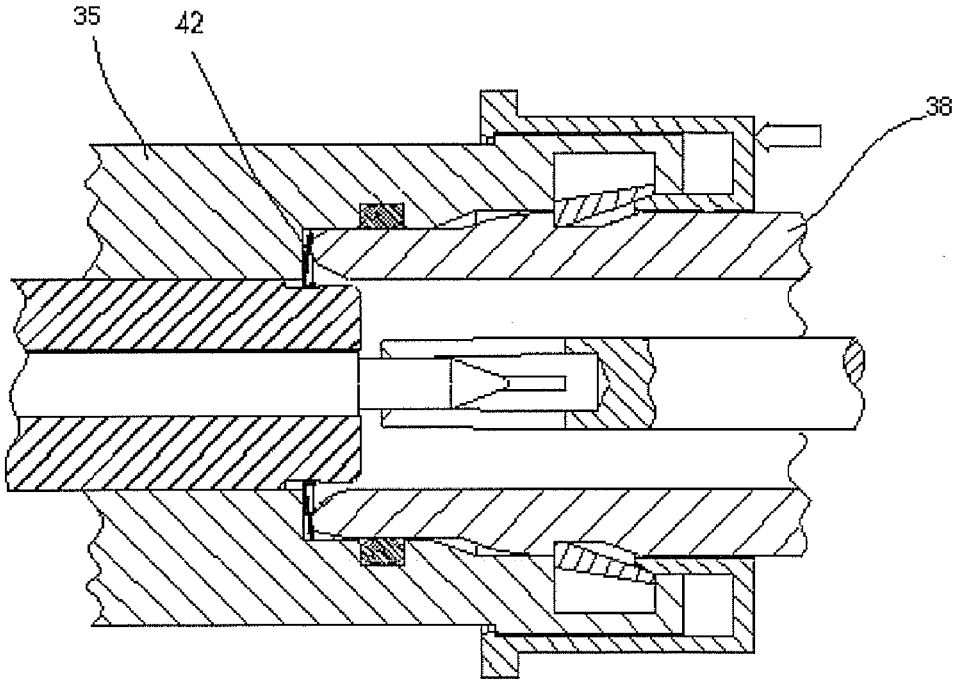
FIG. 9 shows the structure and principle of the electrical connector according to present technologies.
Figure 10:
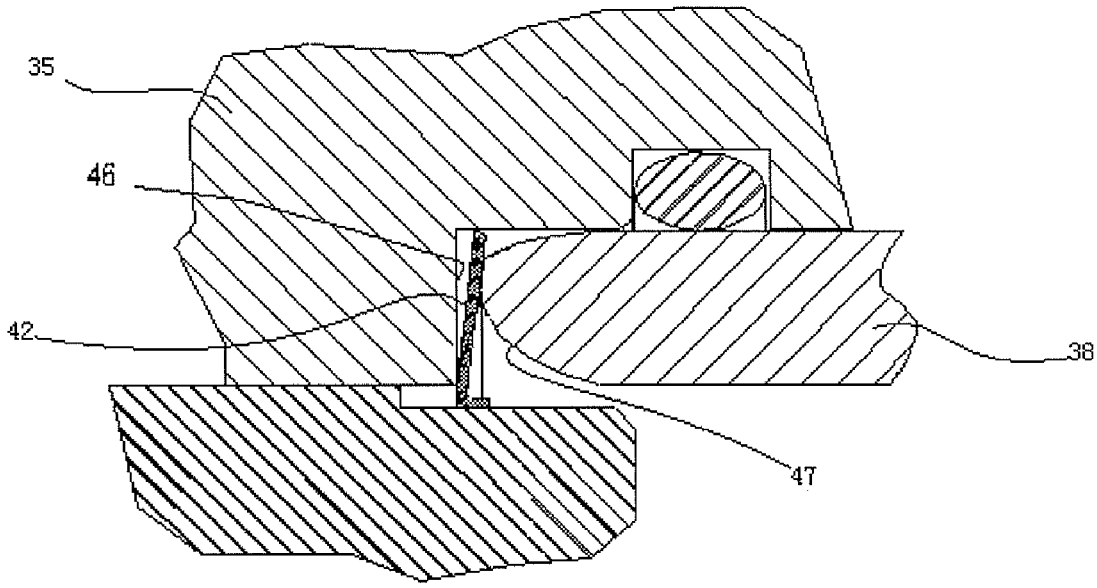
FIG. 10 shows a partially enlarged view of the contact end face of the electrical connector according to prior art as shown in FIG. 9.

As the design of flat valley 14*a* of the down-slope 14, not all of the flexural deformation of inner teeth 24 are released, so some elasticity still exists in a direction to the axis, thus make the connection more reliable. As shown in FIGS. 8*a*-8*c*, this connection process makes zero clearance between the two contact surfaces of the two connectors.

Owing to this connection and locking style, the RF coaxial connector according to the present invention is with continuous impedance, small and stable contact resistance, greatly reduced RF emission, as well as very small RF reflection on the contact ends 4*a* and 5*a*.

In addition, the RF coaxial connector according to the present invention has good passive inter-modulation and very small insertion loss.

Figure 7:
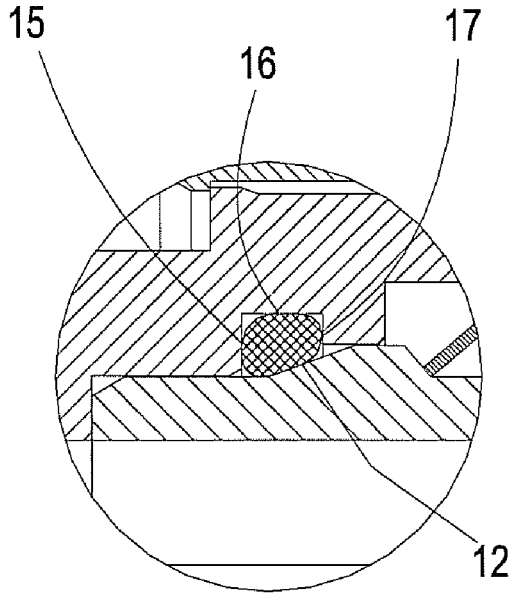
FIG. 7 shows the principle of waterproof sealing in the electrical connector according to the present invention.

In addition, as shown in FIG. 7, when the plug connector 2 is connected to the socket connector 3, a relatively large compression deformation is caused by the upslope 12 of the outer conductor 3 to the half-exposed seal ring 11. As a result, the O-ring seal 11 compresses the inner walls 15, 16, and 17 of the groove, the upslope 12 and the cylindrical surface 12*a*, which enables a good hermetic seal and anti-shock performance of this pair of connectors in connection.

It can be seen from FIG. 1 that, the portion 9*a* of clamp ring 9 abuts against to the outer teeth of the locking sheet 8. This makes the locking sheet 8 reliable installation, stable in locking. In addition, the portion 9*b* of the clamp ring 9 greatly improves the retention force for interface of the locking sheet 8.

Figure 4:
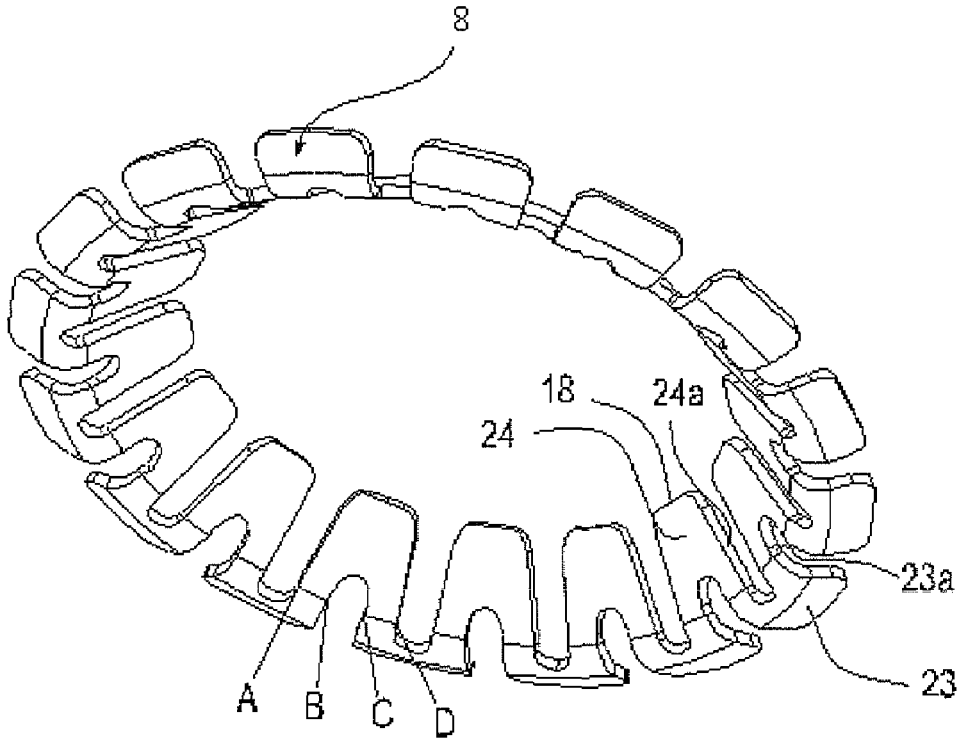
FIG. 4 shows a perspective view of the ring-like locking sheet with inner and outer teeth of the electrical connector according to the present invention.
Figure 5:
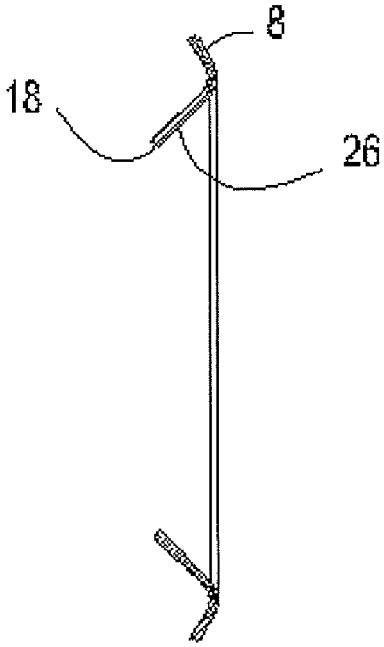
FIG. 5 shows a cross section of the ring-like locking sheet with inner and outer teeth of the electrical connector according to the present invention.
Figure 6:
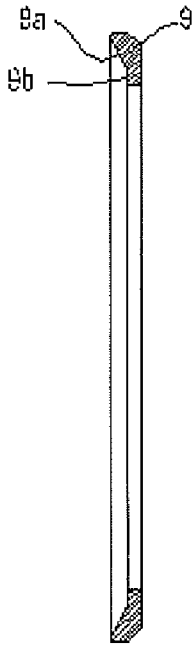
FIG. 6 shows a cross section of the clamp ring of the electrical connector according to the present invention.

According to the present invention, as shown in FIG. 4, the ring-like locking sheet with inner and outer teeth 8 can be designed to have 12-24 outer teeth 23 and inner teeth 24 for different requirement of different connectors, with all the outer teeth having the same height as each other, and the adjacent inner teeth having little different heights.

In the locking condition, the included angle between the longer inner teeth 24 and the down-slope 14 is $\geqq 90°$ (See FIG. 8*a*), while that between the shorter inner teeth 24 and the down-slope 14 is $\leqq 90°$ (See FIG. 8*c*). Therefore, when the down-slope 14 is locked to locking sheet 8, the locking sheet 8 remains certain elasticity to the down-slope both in the longitudinal and radial directions, so as to increase the reliability of the locking.

Slits 23*a* and 24*a* are provided both between the outer teeth and the inner teeth. The outer teeth 23 are used for fixing, and the inner teeth 24 for supporting in locking. The slits between the outer and those between inner teeth can elastically deformed so as to accumulate energy. In addition, when the tops of the inner teeth are under stress, the elastic deformation only happens to two sections AB and CD of the supporting base AD, so the unlocking force is reduced. When the inner teeth are used for supporting, the relatively long base of AD can stand very strong force.

As shown in FIG. 1, to separate the connector, it only needs to move the unlocking sleeve 10, so that the portion 20 of the unlocking sleeve 10 pushes the portion 26 of the locking sheet 8, to separate it from the down-slope 14 and being over the flat top 13 to finally unlock it. Then, the plug connector 2 is in disengagement with the socket connector 3. At this moment, all the flexural deformations of the ring-like locking sheet with inner and outer teeth 8 generated in the connection are completely released, and all the inner teeth restore to their original free state.

In the connection of the electrical connector according to the present invention, as shown in FIGS. 8*a* to 8*c*, certain forces generated by the end surface 18 of the inner tooth 24 of the ring-like locking sheet with inner and outer teeth 8 in the normal direction of the down-slope 14 cause the generation of a very strong thrust on the interface 4*a* of one connector 3 to contact the interface 5*a* of another connector 2. Therefore, the RF coaxial connector according to the present invention can have rigid zero clearance between the contact surfaces just like the conventional RF coaxial connector with threaded connection can do, and at the same time keep the continuous impedance on the interfaces and no reflection in the transmission of electromagnetic waves. Meanwhile, the outer conductor end surface 4*a* of the connector socket 3 has a strong axial pressure to the end surface 5*a* of the plug connector 2, which results in a very small and stable contact resistance in connection.

The electrical connector according to the present invention can realize the quick-insertion and self-locking functions, and can be widely used in the RF coaxial connectors or other electrical connectors.

According to the present invention, as shown in FIGS. 8*a* to 8*c*, the adjacent inner teeth 24 with different height of the ring-like locking sheet with inner and outer teeth 8 support on the trapezoidal down-slope 14 at different circumferences to ensure the zero clearance between the contact surfaces 4*a* and 5*a* of the connector in connection, with a strong axial pressure between them at the same time. As for the electrical performance, it avoids the reflection caused by the discontinuous impedance on the contact surfaces and has relatively small VSWR, and especially has the good passive intermodulation and low insertion loss.

According to the present invention, as shown in FIG. 7, in the mechanical connection of the connector, the half-exposed O-ring seal 11 confined by inner walls 15, 16 and 17 of the plug connector is compressed to deform by the cylindrical surface 12*a* of the socket connector and the upslope 12. This causes the contact pressures of the seal ring to the inner walls 15, 16 and 17 of the grooves, to the upslope 12, as well as to the cylindrical surface 12*a*, and as a result improves the seal effect and anti-shock performance of the connector.

According to the present invention, a clamp ring 9 is arranged on the locking sheet of the plug connector. Meanwhile, the convex surface of the elastic portion of the locking sheet 8 abuts against the portion 9*b* of the clamp ring. When the inner teeth are under stress, the closed clamp ring can guarantee enough supporting capacity to increase the supporting ability of the inner teeth of the locking sheet, so as to improve the reliability of the locking sheet and performances such as retention force for interface, and durability, etc.

The RF coaxial connector according to the present invention is simple in structure and easy in manufacturing. It can be used in many cases to replace the RF coaxial connector with threaded connection, with no change or little change of the inner size of the present RF coaxial connectors to upgrade them into the electrical connector with self-locking by snap-fastening, saving a lot of time of design and test.

As a matter of fact, with the concept of the present invention, there can be many other embodiments. Those skilled in the art can easily modify, alter or improve the present invention according to the disclosures of this patent application. For example, an elastic portion can be arranged on locking sheet 8 so as to omit the clamp ring 9. However, this will fall into the scope of protection as claimed in the attached claims.

The invention claimed is:

1. An electrical connector (1) with a plug connector (2) and a socket connector (3), characterized in that a ring-like locking sheet with inner and outer teeth (8) is fixed at the end of the plug connector (2), and a circumferential bulge, with trapezoid cross section which has an upslope (12), a flat top (13) and a down-slope (14), is provided on the surface of the outer conductor of the socket connector (3), thus, in connection, inner teeth (24) reach the maximum flexural deformation when go up along the slope (12) to the flat top (13), then, when move to the down-slope (14), the deformed inner teeth (24) gradually restore their original state in the tangential direction of the down-slope (14), and finally the inner teeth (24) stop at the down-slope (14) or at the juncture of the down-slope (14) and the flat valley (14*a*), in this situation, the end faces (18) of the inner teeth generate a thrust in the normal direction of the down-slope (14), making a closely contact between the end faces (4*a*) and (5*a*) with zero clearance and with axial forces.

2. The electrical connector (1) according to claim 1, characterized in that the plug connector (2) comprises an outer conductor (5) and a core conductor (7), and the socket connector (3) also comprises an outer conductor (4) and a core conductor (6), when the plug connector (2) is connected to the socket connector (3), the outer conductor (5) is connected to the outer conductor (4), and the core conductor (7) is inserted into the core conductor (6).

3. The electrical connector (1) according to claim 1, characterized in that the adjacent inner teeth of the ring-like locking sheet with inner and outer teeth (8) have little different height, which enable the inner teeth stably stop in different circumferences of the down-slope (14) in locking, with the included angle between the longer teeth and the down-slope (14) being $\geqq 90°$ while that between the shorter teeth and the down-slope (14) being $\leqq 90°$.

4. The electrical connector (1) according to claim 3, characterized in that the outer teeth (23) of the ring-like locking sheet with inner and outer teeth (8) are arranged on the same circumference and fixed between the end face (21) of the outer conductor (5) and the clamp ring (9), and slits are provided both between the outer teeth and between the inner teeth.

5. The electrical connector (1) according to claim 1, characterized in that the plug connector (2) has an inner bore (25), and the flat top (13) of the socket connector (3) is in engagement with the inner bore (25) of the plug connector (2).

6. The electrical connector (1) according to claim 4, characterized in that the clamp ring (9) tightly presses the outer teeth (23) of the locking sheet (8).

7. The electrical connector (1) according to claim 2, characterized in that the outer conductor (5) of the plug connector (2) has a circumferential groove with an O-ring seal in it.

8. The electrical connector (1) according to claim 1, characterized in that an unlocking sleeve (10) is provided with the portion (20) of the unlocking sleeve (10) is in alignment with the unlocking portion (26) of the locking sheet (8).

9. The electrical connector (1) according to claim 1, characterized in that, between the plug connector (2)'s cylindrical surface (27) with a shorter inner diameter and the plug connector (2)'s cylindrical surface (25) with a longer inner diameter, there is arranged a circumferential groove defined by inner walls (15, 16, 17) with an O-ring seal (11) being within the groove.

10. The electrical connector (1) according to claim 9, characterized in that, in connection of said electrical connector (1), the plug connector (2)'s cylindrical surface (27) with a shorter inner diameter faces the cylindrical surface (12*a*) of the socket connector (3), while the plug connector (2)'s cylindrical surface (25) with a longer inner diameter faces the upslope (12) of the circumferential bulge of the socket connector (3).

* * * * *